US012241466B2

(12) United States Patent
Kim et al.

(10) Patent No.: US 12,241,466 B2
(45) Date of Patent: Mar. 4, 2025

(54) HERMETIC COMPRESSOR WITH OIL BLOCKING GUIDE

(71) Applicant: SAMSUNG ELECTRONICS CO., LTD., Suwon-si (KR)

(72) Inventors: Joonhyung Kim, Suwon-si (KR); Munseong Kwon, Suwon-si (KR); Jaewoo Park, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 0 days.

(21) Appl. No.: 18/240,729

(22) Filed: Aug. 31, 2023

(65) Prior Publication Data

US 2024/0077077 A1 Mar. 7, 2024

Related U.S. Application Data

(63) Continuation of application No. PCT/KR2023/008004, filed on Jun. 12, 2023.

(51) Int. Cl.
*F04C 15/00* (2006.01)
*F04C 2/30* (2006.01)

(52) U.S. Cl.
CPC ..... *F04C 15/0088* (2013.01); *F04C 2/30* (2013.01); *F04C 2240/30* (2013.01); *F04C 2240/60* (2013.01)

(58) Field of Classification Search
CPC .... F04C 15/0088; F04C 2/30; F04C 2240/30; F04C 2240/60; F04C 18/0215; F04C 18/356; F04C 29/026; F04C 23/008
(Continued)

(56) References Cited

U.S. PATENT DOCUMENTS 6,533,558 B1 3/2003 Matsumoto et al.
8,801,397 B2 8/2014 Okaichi et al.
(Continued)

FOREIGN PATENT DOCUMENTS

CN 1061743 C 2/2001
CN 1121557 C 9/2003
(Continued)

OTHER PUBLICATIONS

Translation JP-2009068453-A (Year: 2024).*
(Continued)

*Primary Examiner* — J. Todd Newton
(74) *Attorney, Agent, or Firm* — STAAS & HALSEY LLP

(57) ABSTRACT

A hermetic compressor including a casing; a motor inside the casing, and including a rotor and stator; a drive shaft that rotates with the rotor; a compression unit below the motor to compress refrigerant and discharge compressed refrigerant to an inside of the casing; and an oil blocking guide above the motor to rotate with the rotor. The oil blocking guide includes an oil blocking plate formed in a disk shape, an oil guide part extending outward and upward from an edge of the oil blocking plate, and a support part connecting the oil blocking plate to the drive shaft and space the oil blocking plate from the rotor. The oil blocking plate and the oil guide part block upward movement of oil passing through the motor, and guide the oil to an inner circumferential surface of the casing through centrifugal force while the oil blocking guide is rotating.

15 Claims, 12 Drawing Sheets

(58) Field of Classification Search
USPC ..... 418/55.1
See application file for complete search history.

(56) References Cited

U.S. PATENT DOCUMENTS

| | | | | |
|---|---|---|---|---|
| 8,864,480 | B2 | 10/2014 | Jung et al. | |
| 10,047,746 | B2 | 8/2018 | Koyama et al. | |
| 11,293,440 | B2 | 4/2022 | Kim et al. | |
| 11,408,426 | B2 | 8/2022 | Jeon et al. | |
| 2012/0189470 | A1* | 7/2012 | Okaichi | F04C 29/023 417/321 |
| 2020/0149547 | A1 | 5/2020 | Kim et al. | |
| 2020/0149548 | A1 | 5/2020 | Kim et al. | |
| 2020/0256600 | A1* | 8/2020 | Jeon | F04C 23/008 |
| 2024/0077077 | A1* | 3/2024 | Kim | F04C 18/356 |

FOREIGN PATENT DOCUMENTS

| | | | | | |
|---|---|---|---|---|---|
| CN | 106640661 | B | | 4/2019 | |
| JP | 2007-255214 | A | | 10/2007 | |
| JP | 2009068453 | A | * | 4/2009 | |
| JP | 5647989 | | | 1/2015 | |
| JP | 5897117 | B2 | | 3/2016 | |
| JP | 2018119437 | A | * | 8/2018 | F04C 23/02 |
| JP | 2021-50619 | A | | 4/2021 | |
| KR | 10-1474019 | B1 | | 12/2014 | |
| KR | 10-2018-0090677 | A | | 8/2018 | |
| KR | 10-2020-0054785 | A | | 5/2020 | |
| KR | 10-2020-0098158 | A | | 8/2020 | |

OTHER PUBLICATIONS

Translation JP-2018119437-A (Year: 2024).*
International Search Report dated Oct. 4, 2023 for International Application No. PCT/KR2023/008004.
Written Opinion of the International Searching Authority dated Oct. 4, 2023 for International Application No. PCT/KR2023/008004.

* cited by examiner

HERMETIC COMPRESSOR WITH OIL BLOCKING GUIDE

CROSS-REFERENCE TO RELATED APPLICATION(S)

This application is a continuation application, claiming priority under § 365(c), of an International application No. PCT/KR2023/008004, filed on Jun. 12, 2023, which is based on and claims the benefit of a Korean patent application number 10-2022-0110758, filed on Sep. 1, 2022, in the Korean Intellectual Property Office, the disclosure of which is incorporated by reference herein in its entirety.

BACKGROUND

1. Field

The disclosure relates to a hermetic compressor, and more particularly, to a hermetic compressor having an oil blocking guide.

2. Description of the Related Art

A hermetic compressor refers to a mechanical device that increases the pressure of gas by compressing gas, and may be classified into a reciprocating compressor and a rotating compressor according to an operation principle.

The reciprocating compressor includes a compressor that converts the rotational motion of a motor into linear reciprocating motion of a piston using a crankshaft and a connecting rod to suck in and compress gas.

The rotating compressor includes a rotary compressor and a scroll compressor.

The rotary compressor is configured to absorb and compress refrigerant while a roller rotates in a cylinder of a compression unit by the rotational motion of a motor.

The scroll compressor is configured to absorb and compress refrigerant while an orbiting scroll orbits with respect to a fixed scroll in a predetermined direction by the rotational motion of a motor.

In the rotary compressor, compressed refrigerant is discharged to the inside of a casing, and then is discharged to the outside together with oil through a refrigerant discharge pipe.

SUMMARY

Aspects of embodiments of the disclosure will be set forth in part in the description which follows and, in part, will be apparent from the description, or may be learned by practice of the presented embodiments.

According to an embodiment of the disclosure, a hermetic compressor includes a casing; a motor inside the casing, and including a rotor and stator; a drive shaft configured to rotate with the rotor; a compression unit below the motor and configured to compress refrigerant and discharge compressed refrigerant to an inside of the casing according to rotation of the drive shaft; and an oil blocking guide above the motor and configured to rotate integrally with the rotor, wherein the oil blocking guide includes an oil blocking plate formed in a disk shape, an oil guide part extending outward and upward from an edge of the oil blocking plate, and a support part connecting the oil blocking plate to the drive shaft so as to space the oil blocking plate from the rotor, wherein the oil blocking plate and the oil guide part block upward movement of oil passing through the motor, and guide the oil passing through the motor to an inner circumferential surface of the casing through centrifugal force while the oil blocking guide is rotating.

According to an embodiment of the disclosure, a diameter of the oil blocking guide is equal to or larger than a diameter of the rotor of the motor.

According to an embodiment of the disclosure, a ratio of the diameter of the oil blocking guide to the diameter of the rotor is in a range of 1.0 to 1.7.

According to an embodiment of the disclosure, a diameter of the oil blocking plate is smaller than the diameter of the oil blocking guide.

According to an embodiment of the disclosure, a ratio of the diameter of the oil blocking plate to the diameter of the rotor is in a range of 0.7 to 1.2.

According to an embodiment of the disclosure, the oil guide part is inclined in a range of 30 degrees to 70 degrees with respect to a rotational axis of the oil guide part.

According to an embodiment of the disclosure, the oil guide part is formed in a hollow truncated cone shape.

According to an embodiment of the disclosure, the oil guide part includes a plurality of oil outlets passing through the oil guide part.

According to an embodiment of the disclosure, the support part includes a through hole, the drive shaft includes a coupling groove formed at an upper end of the drive shaft, and the oil blocking guide is coupled to the drive shaft by a bolt inserted into the through hole of the support part and coupled to the coupling groove.

According to an embodiment of the disclosure, a length of the support part is in a range of 0.5 to 1.2 times a diameter of the rotor.

According to an embodiment of the disclosure, the hermetic compressor further includes a refrigerant discharge pipe provided on an upper surface of the casing, wherein the oil blocking guide is disposed at a predetermined distance below the refrigerant discharge pipe.

According to an embodiment of the disclosure, a distance between the oil blocking plate of the oil blocking guide and a lower end of the refrigerant discharge pipe is in a range of 0.5 to 5 times a diameter of the refrigerant discharge pipe.

According to an embodiment of the disclosure, a hermetic compressor includes a casing; a motor inside the casing, and including a rotor and stator; a drive shaft configured to rotate with the rotor; a compression unit below the motor and configured to compress refrigerant and discharge compressed refrigerant to an inside of the casing according to rotation of the drive shaft; and an oil blocking guide above the motor and configured to rotate integrally with the rotor, wherein the oil blocking guide includes an oil blocking plate formed in a disk shape and spaced a predetermined distance from an upper end of the rotor, and an oil guide part extending outward and upward from an edge of the oil blocking plate, wherein the oil blocking plate and the oil guide part block upward movement of oil passing through the motor, and guide the oil passing through the motor to an inner circumferential surface of the casing through centrifugal force while the oil blocking guide is rotating.

According to an embodiment of the disclosure, a diameter of the oil blocking guide is equal to or larger than a diameter of the rotor of the motor.

According to an embodiment of the disclosure, a diameter of the oil blocking plate is smaller than a diameter of the oil blocking guide.

BRIEF DESCRIPTION OF THE DRAWINGS

These and/or other aspects, features, and advantages of embodiments of the disclosure will be more apparent from the following description taken in conjunction with the accompanying drawings, in which.

DETAILED DESCRIPTION

Figure 1:
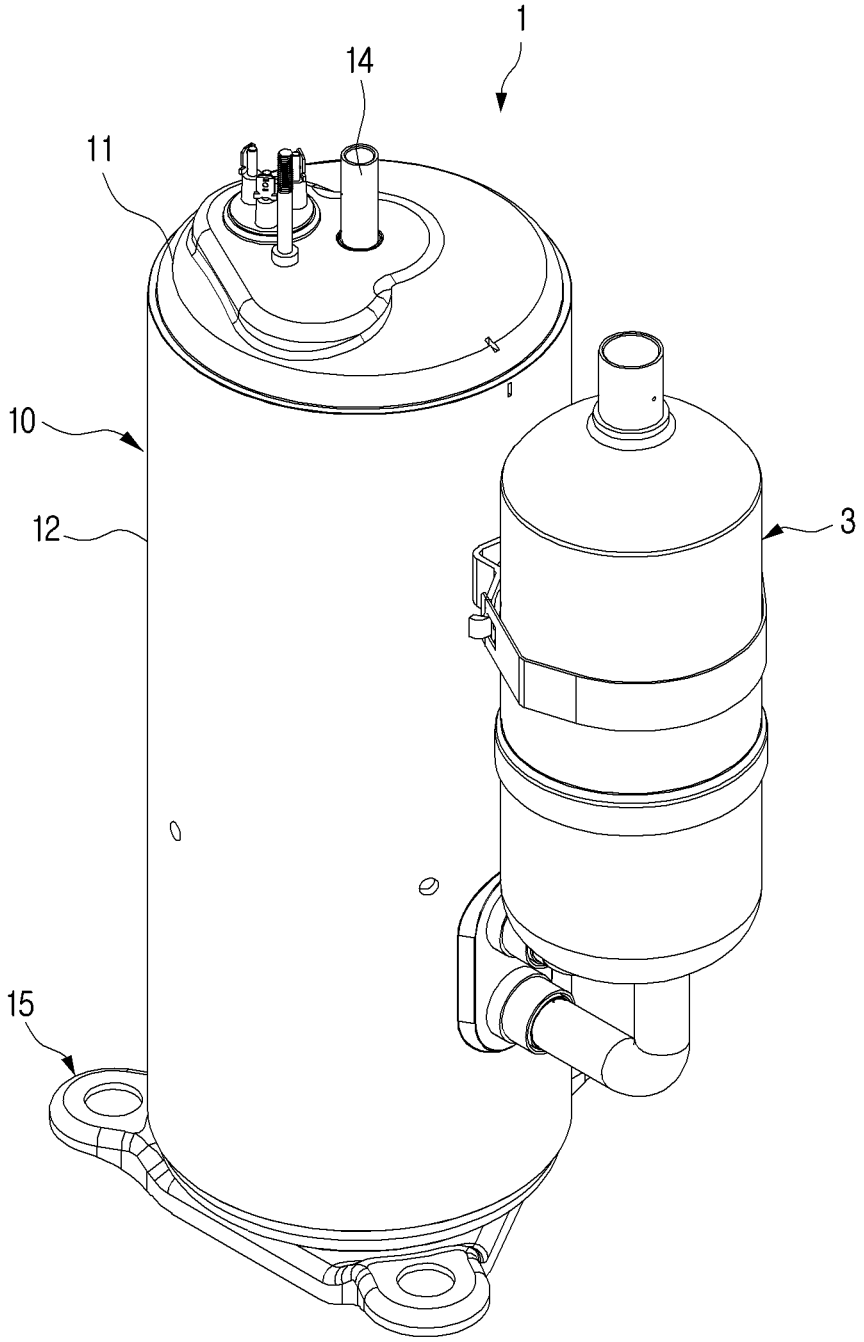
FIG. 1 is a perspective view illustrating a hermetic compressor according to one or more embodiments of the disclosure.

Since the embodiments of the disclosure can apply various transformations and have various embodiments, specific embodiments will be illustrated in the drawings and described in detail in the detailed description. However, this is not intended to limit the scope to the specific embodiments, and should be understood to include various modifications, equivalents, and/or alternatives of the embodiment of the disclosure. In connection with the description of the drawings, like reference numerals may be used for like elements.

In describing the disclosure, when it is determined that a detailed description of a related known function or configuration may unnecessarily obscure the gist of the disclosure, a detailed description thereof will be omitted.

In addition, the following embodiments may be modified in many different forms, and the scope of the technical idea of the disclosure is not limited to the following embodiments. Rather, these embodiments are provided so that this disclosure will be thorough and complete, and will fully convey the spirit of the disclosure to those skilled in the art.

Terms used in this disclosure are only used to describe specific embodiments, and are not intended to limit the scope of rights. Singular expressions include plural expressions unless the context clearly dictates otherwise.

In this disclosure, expressions such as "has," "can have", "includes," or "can include" indicate the existence of a corresponding feature (e.g., numerical value, function, operation, or component such as a part) and do not preclude the existence of additional features.

In this disclosure, expressions such as "A or B," "at least one of A or/and B," or "one or more of A or/and B" may include all possible combinations of the items listed together. For example, "A or B," "at least one of A or/and B," or "one or more of A or/and B" may refer to all cases (1) including at least one A, (2) including at least one B, or (3) including both at least one A and at least one B.

Expressions such as "first," "second," "primary," or "secondary," as used in this disclosure may modify various components regardless of order and/or importance, are used only to distinguish one component from other components, and do not limit the corresponding components.

Further, terms such as 'leading end', 'rear end', 'upper side', 'lower side', 'top end', 'bottom end', etc. used in the disclosure are defined with reference to the drawings. However, the shape and position of each component are not limited by these terms.

Hereinafter, embodiments of a hermetic compressor according to the disclosure will be described in detail with reference to the accompanying drawings.

FIG. 1 is a perspective view illustrating a hermetic compressor according to one or more embodiments of the disclosure.

Referring to FIG. 1, a hermetic compressor 1 according to one or more embodiments of the disclosure may include a casing 10.

The casing 10 forms the appearance of the hermetic compressor 1. The casing 10 is formed as a sealed container. The casing 10 may include a refrigerant inlet 13 through which refrigerant is introduced and a refrigerant discharge pipe 14 through which refrigerant is discharged.

The hermetic compressor 1 may form a refrigeration cycle with a condenser, an expansion valve, and an evaporator. In this case, the refrigerant inlet 13 may be connected to the evaporator, and the refrigerant discharge pipe 14 may be connected to the condenser.

An accumulator 3 may be disposed on one side of the hermetic compressor 1. In this case, the refrigerant inlet 13 may be connected to the accumulator 3. Because the inlet pipe of the accumulator 3 is connected to the evaporator, the refrigerant discharged from the evaporator may flow into the hermetic compressor 1 through the accumulator 3.

The casing 10 may include an upper casing 11 and a lower casing 12. The upper casing 11 is coupled to the top end of the lower casing 12 to form the casing 10.

The connecting portion of the upper casing 11 and the lower casing 12 is sealed.

The refrigerant discharge pipe 14 is provided in the upper casing 11. The refrigerant discharge pipe 14 may be provided at a top end of the upper casing 11.

The refrigerant inlet 13 is provided in the lower casing 12. The refrigerant inlet 13 communicates with a compression unit 40 disposed in the lower casing 12. A low-temperature/low-pressure refrigerant may flow into the refrigerant inlet 13. Thus, the refrigerant may flow into the compression unit 40 through the refrigerant inlet 13.

The accumulator 3 may be disposed in the lower casing 12. In this case, the refrigerant inlet 13 may be connected to the discharge pipe of the accumulator 3.

A base 15 supporting the casing 10 may be provided below the lower casing 12. The hermetic compressor 1 may be disposed vertically with respect to the support surface by means of the base 15.

Figure 2:
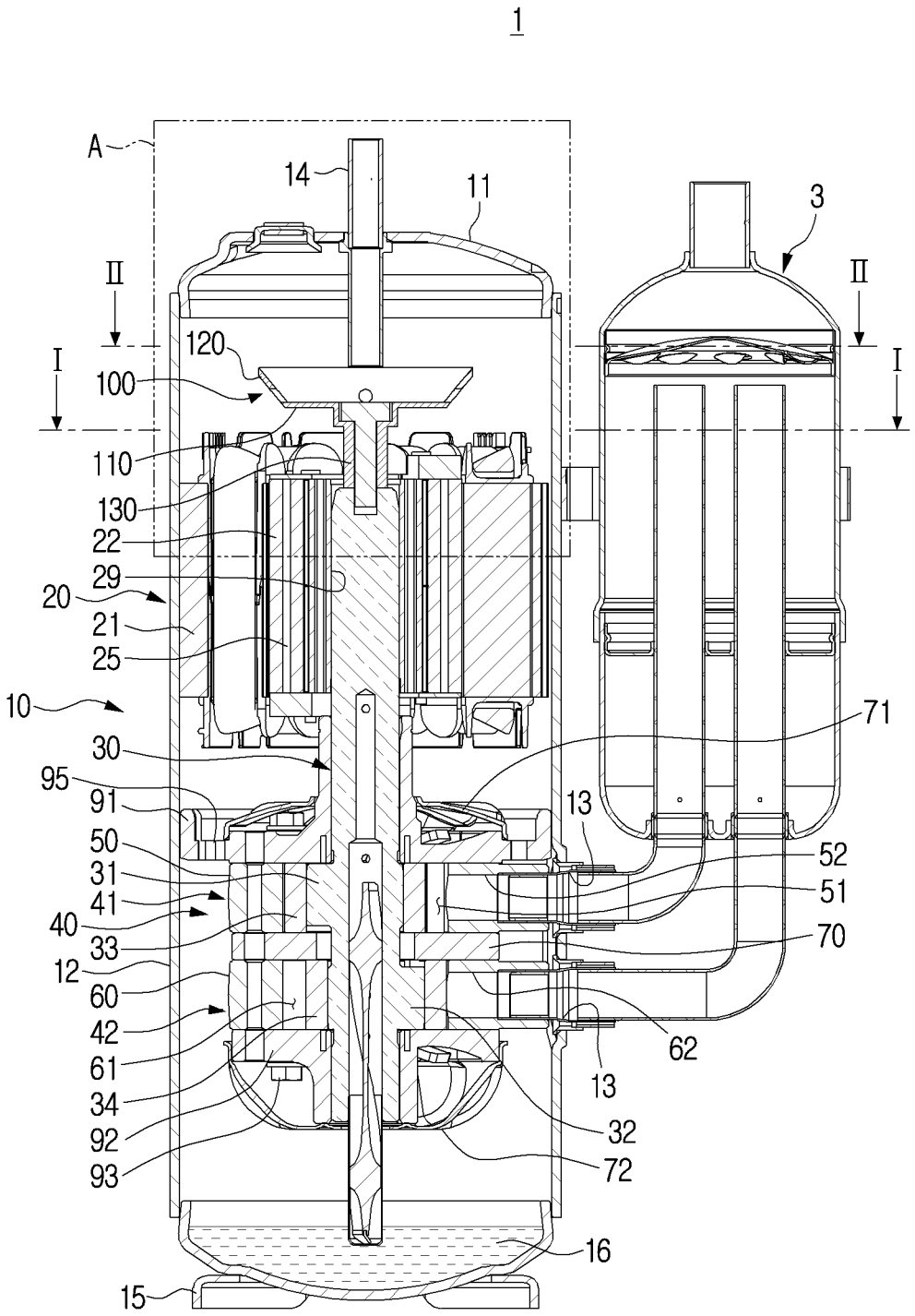
FIG. 2 is a cross-sectional view illustrating a hermetic compressor according to one or more embodiments of the disclosure.
Figure 3:
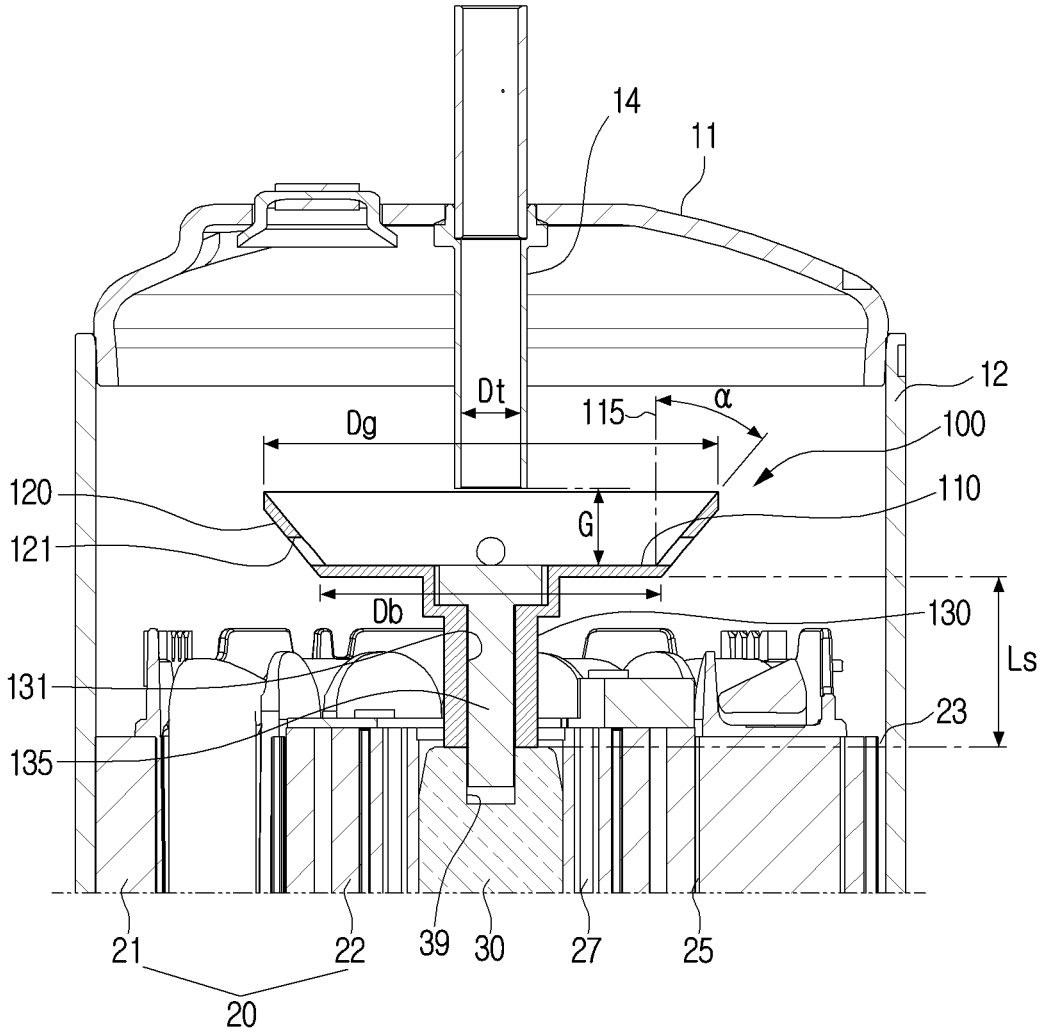
FIG. 3 is an enlarged cross-sectional view illustrating the part A of FIG. 2.
Figure 4:
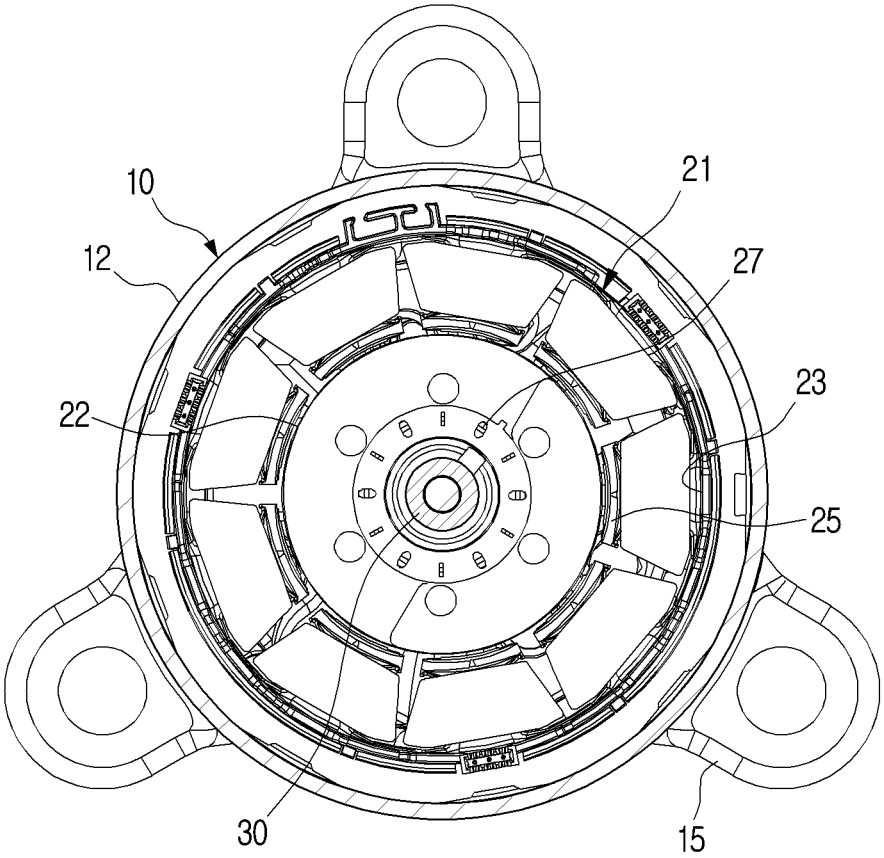
FIG. 4 is a cross-sectional view illustrating the hermetic compressor of FIG. 2 taken along line I-I.
Figure 5:
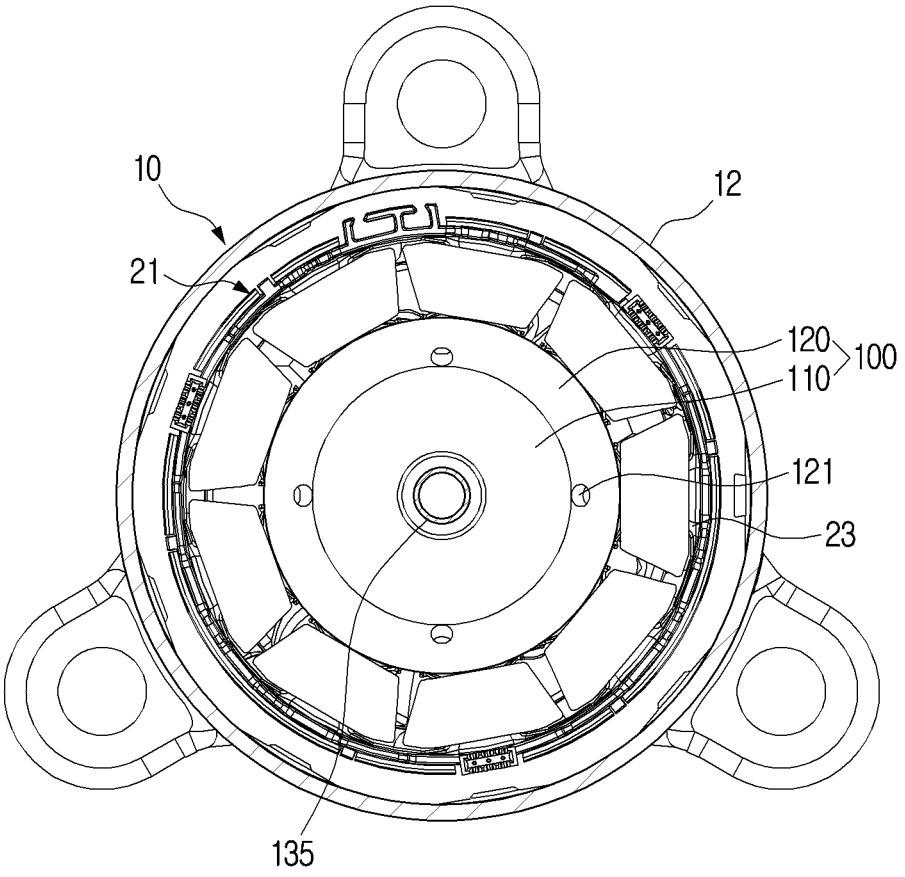
FIG. 5 is a cross-sectional view illustrating the hermetic compressor of FIG. 2 taken along line II-II.

FIG. 2 is a cross-sectional view illustrating a hermetic compressor according to one or more embodiments of the disclosure. FIG. 3 is an enlarged cross-sectional view illustrating the part A of FIG. 2. FIG. 4 is a cross-sectional view illustrating the hermetic compressor of FIG. 2 taken along line I-I. FIG. 5 is a cross-sectional view illustrating the hermetic compressor of FIG. 2 taken along line II-II.

Referring to FIGS. 2 and 3, the hermetic compressor 1 according to one or more embodiments of the disclosure may include a casing 10, a motor 20, a compression unit 40, and an oil blocking guide 100.

The casing 10 forms the appearance of the hermetic compressor 1 and is a cylindrical hermetically sealed container. The casing 10 may include a lower casing 12 provided with a refrigerant inlet 13 and an upper casing 11 provided with a refrigerant discharge pipe 14.

The casing 10 is formed by coupling the upper casing 11 and the lower casing 12, and the inside of the casing 10 except for the refrigerant inlet 13 and the refrigerant discharge pipe 14 may be sealed. In other words, the refrigerant may flow into the casing 10 or flow out of the casing 10 only through the refrigerant inlet 13 and the refrigerant discharge pipe 14.

The high-pressure refrigerant discharged from the compression unit 40 is accommodated in the inner space of the casing 10 and is discharged to the outside through the refrigerant discharge pipe 14.

An oil reservoir 16 for accommodating oil may be provided at a lower portion of the casing 10.

An accumulator 3 may be disposed on an outer circumferential surface of the casing 10. In this case, the refrigerant inlet 13 may be connected to the discharge pipe of the accumulator 3.

The motor 20 may be disposed at the upper side of the inside of the casing 10. The motor 20 may include a stator 21 and a rotor 22.

The stator 21 of the motor 20 is fixed to the inner circumferential surface of the casing 10. A plurality of oil return passages 23 may be provided between the outer circumferential surface of the stator 21 and the inner circumferential surface of the casing 10. The plurality of oil return passages 23 may be formed at regular intervals along the outer circumferential surface of the stator 21.

For example, the outer circumferential surface of the stator 21 may be formed in a substantially regular polygonal cross-sectional shape. When the stator 21 having the regular polygon cross-section is disposed in the cylindrical casing 10, the plurality of oil return passages 23 may be formed between the outer circumferential surface of the stator 21 and the inner circumferential surface of the casing 10.

Oil at the upper side of the motor 20 may move to the lower side of the motor 20 through the plurality of oil return passages 23 provided between the stator 21 and the casing 10. The oil moved below the motor 20 may be collected in the oil reservoir 16 provided at the lower portion of the casing 10.

The rotor 22 may be rotatably disposed at the center of the stator 21. The rotor 22 is disposed to maintain a predetermined gap with the inner surface of the stator 21. Thus, an annular space may be provided between the rotor 22 and the stator 21.

A shaft hole 29 may be formed at the center of the rotor 22 to penetrate the rotor 22 in the longitudinal direction. A plurality of refrigerant holes 27 may be formed around the shaft hole 29 of the rotor 22. The plurality of refrigerant holes 27 may be formed to penetrate the rotor 22 in the longitudinal direction, that is, in a vertical direction.

The refrigerant containing the oil below the motor 20 may move to the upper side of the motor 20 through the plurality of refrigerant holes 27 and the gap 25 between the rotor 22 and the stator 21.

A drive shaft 30 is inserted into the shaft hole 29 penetrating the center of the rotor 22 and fixed thereto. Therefore, when power is applied to the motor 20, the rotor 22 may be rotated by the electromagnetic force acting between the stator 21 and the rotor 22, and the drive shaft 30 may be rotated integrally with the rotor 22.

The oil blocking guide 100 may be disposed at the upper end of the drive shaft 30. The compression unit 40 may be disposed at the lower end of the drive shaft 30. Therefore, when the drive shaft 30 is rotated by the motor 20, the oil blocking guide 100 rotates integrally with the drive shaft 30 and the compression unit 40 operates to compress the refrigerant.

A coupling groove 39 may be formed at the upper end of the drive shaft 30. The coupling groove 39 may be formed as a female thread. The coupling groove 39 may be used to fix the oil blocking guide 100 to the drive shaft 30.

The drive shaft 30 may be formed to protrude below the motor 20. A lower portion of the drive shaft 30 protruding downward of the motor 20 may be connected to the compression unit 40. The lower portion of the drive shaft 30 may be formed as a crankshaft to operate the compression unit 40.

The crankshaft of the drive shaft 30 may include two eccentric parts, that is, an upper eccentric part 31 and a lower eccentric part 32. Accordingly, when the drive shaft 30 rotates, the upper eccentric part 31 and the lower eccentric part 32 of the crankshaft rotate integrally with the drive shaft 30.

The upper eccentric part 31 may be formed in a cylindrical shape having a larger diameter than the diameter of the drive shaft 30, and the center line thereof may be formed to be eccentric with the center line of the drive shaft 30. An upper roller 33 may be disposed on the outer circumferential surface of the upper eccentric part 31.

The lower eccentric part 32 may be disposed under the upper eccentric part 31 and may be formed in the same way as the upper eccentric part 31. In other words, the lower eccentric part 32 may be formed in a cylindrical shape having a larger diameter than the diameter of the drive shaft 30, and the center line thereof may be formed to be eccentric with the center line of the drive shaft 30. A lower roller 34 may be disposed on the outer circumferential surface of the lower eccentric part 32.

The lower eccentric part 32 may be formed to be eccentric in a direction different from that of the upper eccentric part 31 with respect to the center line of the drive shaft 30. For example, the lower eccentric part 32 may be eccentric in a direction opposite to that of the upper eccentric part 31 by 180 degrees with respect to the center line of the drive shaft 30.

The drive shaft 30 may be rotatably supported by an upper bearing 91 and a lower bearing 92. The upper bearing 91 may be disposed to support the drive shaft 30 between the rotor 22 and the upper eccentric part 31, and the lower bearing 92 may be disposed below the lower eccentric part 32 to support the lower end of the drive shaft 30.

The compression unit 40 is disposed below the motor 20. The compression unit 40 may be configured to compress the refrigerant and discharge the compressed refrigerant to the inside of the casing 10 according to the rotation of the drive shaft 30.

The compression unit 40 is disposed in the lower side of the casing 10 and is operated by the drive shaft 30 rotated by the motor 20 to suck in, compress, and discharge the refrigerant. The compression unit 40 may be disposed between the upper bearing 91 and the lower bearing 92 supporting the drive shaft 30.

The compression unit 40 may include an upper compression unit 41, a lower compression unit 42, and an intermediate plate 70 provided between the upper compression unit 41 and the lower compression unit 42.

The upper compression unit 41 is formed to suck in and compress the refrigerant according to the rotation of the drive shaft 30. The lower compression unit 42 is provided below the upper compression unit 41 and is formed to suck in and compress the refrigerant according to the rotation of the drive shaft 30.

The upper compression unit 41 is disposed on the upper surface of the intermediate plate 70 and may include an upper cylinder 50 having a flat plate shape. The upper roller 33 disposed on the upper eccentric part 31 of the drive shaft 30 may be accommodated and rotate in the hollow 51 of the upper cylinder 50.

The upper compression unit 41 may include a refrigerant inlet passage 52 connected to the refrigerant inlet 13 provided in the casing 10. The refrigerant inlet passage 52 is formed in the upper cylinder 50. The refrigerant inlet passage 52 may be formed as a through hole communicating the hollow 51 of the upper cylinder 50 with the outer circumferential surface of the upper cylinder 50. Accordingly, the refrigerant may flow into the hollow 51 of the upper cylinder 50 through the refrigerant inlet 13 and the refrigerant inlet passage 52.

The upper compression unit 41 may include an upper discharge groove through which compressed refrigerant is discharged. The upper discharge groove may be formed on the upper surface of the upper cylinder 50.

When the upper roller 33 is rotated by the drive shaft 30, the refrigerant may flow into the hollow 51 of the upper cylinder 50 through the refrigerant inlet passage 52, may be compressed, and then may be discharged through the upper discharge groove.

The lower compression unit 42 is disposed on the lower surface of the intermediate plate 70 and may include a lower cylinder 34 having a flat plate shape. The lower roller 34 disposed on the lower eccentric part 32 of the drive shaft 30 may be accommodated and rotate in the hollow 61 of the lower cylinder 60.

The lower compression unit 42 may include a refrigerant inlet passage 62 connected to the refrigerant inlet 13 provided in the casing 10. The refrigerant inlet passage 62 is formed in the lower cylinder 60. The refrigerant inlet passage 62 may be formed as a through hole communicating the hollow 61 of the lower cylinder 60 with the outer circumferential surface of the lower cylinder 60. Accordingly, the refrigerant may flow into the hollow 61 of the lower cylinder 60 through the refrigerant inlet 13 and the refrigerant inlet passage 62.

The lower compression unit 42 may include a lower discharge groove through which compressed refrigerant is discharged. The lower discharge groove may be formed on the lower surface of the lower cylinder 60. Accordingly, the refrigerant compressed by the lower compression unit 42 may be discharged below the compression unit 40.

When the lower roller 34 is rotated by the drive shaft 30, the refrigerant may flow into the hollow 61 of the lower cylinder 60 through the refrigerant inlet passage 62, may be compressed, and then may be discharged through the lower discharge groove.

The low-pressure refrigerant may be supplied to the upper compression unit 41 and the lower compression unit 42 through the accumulator 3.

The intermediate plate 70 is disposed between the upper cylinder 50 and the lower cylinder 34. The intermediate plate 70 may be formed in a flat plate shape. Accordingly, the lower cylinder 34, the intermediate plate 70, and the upper cylinder 50 may be stacked to form the compression unit 40. The lower cylinder 34, the intermediate plate 70, and the upper cylinder 50 may be integrally coupled with a plurality of bolts 93.

The upper bearing 91 may be disposed on the upper surface of the upper cylinder 50. The upper bearing 91 may be fixed to the inner circumferential surface of the casing 10. Therefore, by fixing the upper cylinder 50 to the upper bearing 91, the upper cylinder 50 may be fixed relative to the casing 10.

The upper bearing 91 may be formed to rotatably support the drive shaft 30 and block the upper end of the hollow 51 of the upper cylinder 50.

The upper bearing 91 may be provided with a through hole communicating with the upper discharge groove of the upper cylinder 50. Accordingly, the refrigerant discharged through the upper discharge groove of the upper cylinder 50 may be discharged to the upper side of the upper bearing 91 through the through hole of the upper bearing 91.

An upper muffler 71 may be disposed on the upper side of the upper bearing 91. The upper muffler 71 may be provided with a plurality of refrigerant openings through which refrigerant may pass. The refrigerant passing through the upper bearing 91 may be discharged to a space between the motor 20 and the compression unit 40 through the upper muffler 71.

A plurality of openings 95 may be provided at the edge of the upper bearing 91. The plurality of openings 95 may be formed around the upper muffler 71 disposed in the upper bearing 91. The plurality of openings 95 may be formed to vertically pass through the upper bearing 91. The refrigerant discharged from the lower compression unit 42 may move to the upper side of the upper bearing 91 through the plurality of openings 95.

The lower bearing 92 may be disposed on the lower surface of the lower cylinder 60. The lower bearing 92 may be formed to rotatably support the lower end of the drive shaft 30 and block the lower end of the hollow 61 of the lower cylinder 60.

The lower bearing 92 may be provided with a through hole communicating with the lower discharge groove of the lower cylinder 60. Accordingly, the refrigerant discharged through the lower discharge groove of the lower cylinder 60 may be discharged to the lower side of the lower bearing 92 through the through hole of the lower bearing 92.

A lower muffler 72 may be disposed on the lower side of the lower bearing 92. The refrigerant discharged from the lower compression unit 42 may be discharged through the lower muffler 72 to a space below the compression unit 40, that is, to a lower space of the casing 10.

In this embodiment, the compression unit 40 includes two cylinders 50 and 60 and two rollers 33 and 34. However, the structure of the compression unit 40 is not limited thereto. As another example, the compression unit 40 may include one cylinder and one roller.

In the embodiment shown in FIG. 2, the compression unit 40 of the hermetic compressor 1 has the structure of the compression unit of the rotary compressor. However, the disclosure is not limited thereto. The disclosure may be applied to a scroll compressor in which a motor is disposed at the upper side and a compression unit is disposed at the lower side inside the casing. The compression unit of the scroll compressor may include a fixed scroll and an orbiting scroll.

The refrigerant discharged to the lower space of the casing 10 moves into the space between the compression unit 40 and the motor 20 through the space between the compression unit 40 and the casing 10 and the plurality of openings 95 of the upper bearing 91. At this time, because the refrigerant is discharged from the compression unit 40 in a compressed state at a high pressure, the refrigerant moves into the space between the compression unit 40 and the motor 20 while containing the oil received in the oil reservoir 16.

The refrigerant moved to the space between the motor 20 and the compression unit 40 may move to the upper side of the motor 20 through the motor 20. For example, the refrigerant in the space between the motor 20 and the compression unit 40 may move to the upper side of the motor 20 through the gap 25 between the rotor 22 and the stator 21 and the plurality of refrigerant holes 27 provided in the rotor 22.

The refrigerant moved to the upper side of the motor 20 may be discharged to the outside of the casing 10 through the refrigerant discharge pipe 14 disposed in the upper casing 11.

The oil blocking guide 100 is formed to prevent the refrigerant containing oil that has moved to the upper side of the motor 20 from being directly discharged through the refrigerant discharge pipe 14. The oil blocking guide 100 may be formed so that the oil contained in the refrigerant moving to the upper side of the motor 20 may be discharged through the refrigerant discharge pipe 14 at a minimum. The oil blocking guide 100 may be formed to separate the oil included in the refrigerant moving to the upper side of the motor 20. To this end, the oil blocking guide 100 may be formed to block the oil-containing refrigerant that has passed through the motor 20 from directly moving to the refrigerant discharge pipe 14, to separate the oil contained in the refrigerant, and to guide the separated oil to the inner circumferential surface of the casing 10.

The oil blocking guide 100 may be disposed to rotate integrally with the rotor 22 at the upper side of the motor 20. The oil blocking guide 100 may be disposed to rotate integrally with the drive shaft 30 fixed to the rotor 22. The oil blocking guide 100 may be coupled with the drive shaft 30.

Figure 6:
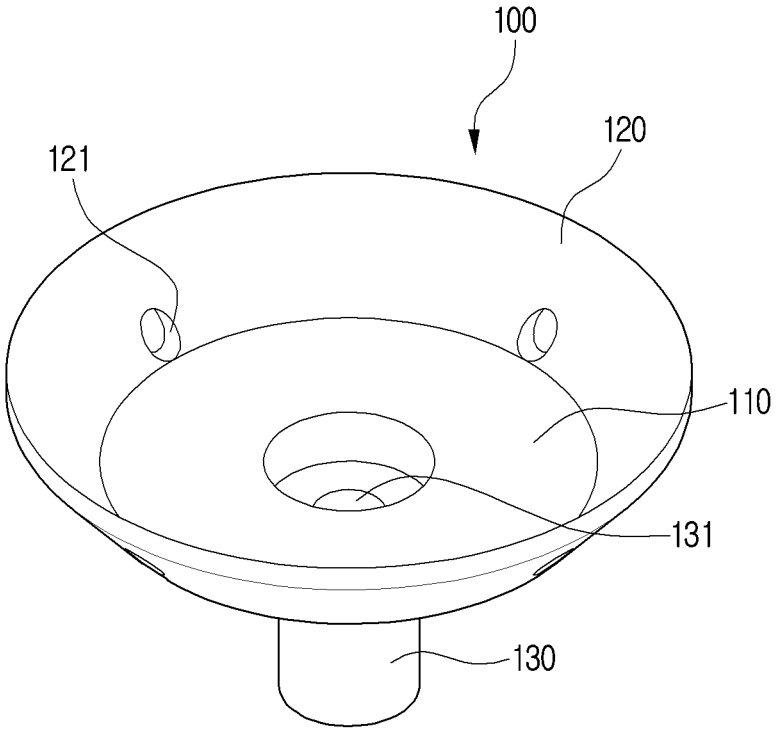
FIG. 6 is a perspective view illustrating an oil blocking guide of a hermetic compressor according to one or more embodiments of the disclosure.

FIG. 6 is a perspective view illustrating an oil blocking guide of a hermetic compressor according to one or more embodiments of the disclosure.

Hereinafter, with reference to FIGS. 3 and 6, the oil blocking guide 100 of the hermetic compressor 1 according to one or more embodiments of the disclosure will be described in detail.

Referring to FIGS. 3 and 6, the oil blocking guide 100 may include an oil blocking plate 110, an oil guide part 120, and a support part 130.

The oil blocking plate 110 may be formed to prevent the oil-containing refrigerant that has passed through the motor 20 from moving upward. In other words, the oil blocking plate 110 may be formed to block the upward movement of the oil included in the refrigerant. Because the upward movement of the oil is blocked by the oil blocking plate 110, the oil may not directly flow into the refrigerant discharge pipe 14.

The oil blocking plate 110 may be formed in a disk shape. The oil blocking plate 110 may be disposed to be spaced apart from the motor 20 upward by a predetermined distance. In other words, the oil blocking plate 110 may be disposed at a predetermined distance from the upper surface of the rotor 22.

The oil guide part 120 may be formed to guide the oil contained in the refrigerant to the inner circumferential surface of the casing 10. The oil guide part 120 may extend obliquely upward with respect to the oil blocking plate 110 from the outer circumferential surface of the oil blocking plate 110. Then, when the oil blocking guide 100 rotates, the oil guide part 120 may guide the oil to the inner circumferential surface of the casing 10.

The oil guide part 120 may be formed to be inclined at an angle of 30 degrees to 70 degrees with respect to an imaginary straight line perpendicular to the oil blocking plate 110. In other words, the oil guide part 120 may be formed to be inclined at an angle of 20 degrees to 60 degrees upward with respect to the lower surface of the oil blocking plate 110 from the edge of the oil blocking plate 110.

Therefore, the oil guide part 120 may be formed in a form that diverges upward from the oil blocking plate 110. That is, the oil guide part 120 may be formed in a hollow truncated cone shape. In other words, the oil guide part 120 may have an inverted truncated cone shape in which the diameter of the upper surface is greater than the diameter of the lower surface. That is, the oil guide part 120 may be formed in a trumpet shape where the diameter of the lower surface is smaller than the diameter of the upper surface.

Therefore, the oil blocking plate 110 and the oil guide part 120 may form a bowl with a flat bottom and an inclined side surface.

The refrigerant and oil whose upward movement is blocked by the oil blocking plate 110 move upward along the oil guide part 120. At this time, when the oil blocking guide 100 rotates, a centrifugal force acts on the refrigerant and oil flowing along the oil guide part 120.

In general, because the density of oil is greater than that of the refrigerant, when a centrifugal force acts on the outer circumferential surface of the oil guide part 120 as the oil blocking guide 100 rotates, oil is separated from the refrigerant and moves toward the inner circumferential surface of the casing 10. Because the centrifugal force acting on the refrigerant is smaller than the centrifugal force acting on the oil, the refrigerant moves to the upper side of the oil blocking guide 100 along the oil guide part 120 and flows into the refrigerant discharge pipe 14. Thus, the oil guide part 120 may separate the oil from the refrigerant.

The oil guide part 120 may be disposed so that the refrigerant moving along the oil guide part 120 flows into the refrigerant discharge pipe 14. In other words, the oil guide part 120 may be disposed so as not to prevent the refrigerant from flowing into the refrigerant discharge pipe 14.

For example, the oil guide part 120 may be formed so as not to contact the upper surface of the casing 10, that is, the upper surface of the upper casing 11 where the refrigerant discharge pipe 14 is provided. The oil guide part 120 may be formed so that its upper end is located below the lower end of the refrigerant discharge pipe 14. As another example, the oil guide part 120 may be formed so that the upper end of the oil guide part 120 is positioned slightly higher than the lower end of the refrigerant discharge pipe 14.

The oil guide part 120 may include a plurality of oil outlets 121. The plurality of oil outlets 121 are formed to pass through the oil guide part 120. Accordingly, the inner space of the oil guide part 120 may communicate with the outside through the plurality of oil outlets 121. The plurality of oil outlets 121 may be formed in contact with or adjacent to the oil blocking plate 110.

Oil existing on the oil guide part 120 may be discharged to the outside of the oil guide part 120 through the plurality of oil outlets 121. When the oil blocking guide 100 rotates, the oil present inside the oil guide part 120 may be discharged to the outside of the oil guide part 120 through the plurality of oil outlets 121 by the centrifugal force, and may be moved inside the casing 10.

The oil blocking guide 100 may be formed to have a diameter equal to or larger than that of the rotor 22 of the motor 20. Here, the diameter of the oil blocking guide 100 refers to the maximum diameter of the oil blocking guide 100. In detail, the diameter of the oil blocking guide 100 refers to the outer diameter of the upper end of the oil guide part 120.

In order for the oil blocking guide 100 to serve to guide the oil contained in the refrigerant moving upward through the motor 20 to the inner circumferential surface of the casing 10, the diameter Dg of the oil blocking guide 100 and the diameter Dr of the rotor 22 may be determined to satisfy a relationship as follows.

Diameter *Dg* of oil blocking guide/diameter *Dr* of rotor=1.0 to 1.7

When the diameter Dg of the oil blocking guide 100, that is, the diameter Dg of the oil guide part 120 is out of the above range, the efficiency of the oil blocking guide 100 separating the oil contained in the refrigerant moving upward through the motor 20 and guiding the separated oil to the inner circumferential surface of the casing 10 may decrease.

The oil guide part 120 may be formed to be positioned above the gap 25 between the rotor 22 and the stator 21. When the oil guide part 120 is formed in this way, the oil-containing refrigerant moving to the upper side of the motor 20 through the gap 25 between the rotor 22 and the stator 21 may be directly guided by the oil guide part 120 and move upward in an inclined direction without colliding with the oil blocking plate 110.

The oil blocking plate 110 may be formed to have a smaller diameter Db than the diameter Dg of the oil blocking guide 100. The diameter Db of the oil blocking plate 110 may be the diameter of the lower end of the oil guide part 120.

In order for the oil blocking guide 100 to serve to guide oil to the inner circumferential surface of the casing 10, the diameter Db of the oil blocking plate 110 and the diameter Dr of the rotor 22 may be determined to satisfy a relationship as follows.

Diameter *Db* of oil blocking plate/diameter *Dr* of rotor=0.7 to 1.2

When the diameter Db of the oil blocking plate 110 is smaller than the diameter Dr of the rotor 22, the oil-containing refrigerant moving upward through the gap 25 between the rotor 22 and the stator 21 may be guided upward by the oil guide part 120 without colliding with the oil blocking plate 110.

When the diameter Db of the oil blocking plate 110 is out of the above range, the efficiency of the oil blocking plate 110 blocking the oil included in the refrigerant moving upward through the motor 20 from directly moving to the refrigerant discharge pipe 14 may decrease. In addition, a phenomenon in which the oil-containing refrigerant is stagnant in a space between the oil blocking plate 110 and the motor 20 may occur.

The support part 130 may be formed to support the oil blocking plate 110 and the oil guide part 120. The support part 130 may be formed to separate the oil blocking guide 100 from the rotor 22 by a predetermined distance and connect the oil blocking guide 100 to the rotor 22.

The support part 130 may be formed to couple the oil blocking guide 100 to the upper end of the drive shaft 30 while being spaced apart from the rotor 22 by a predetermined distance. In other words, the support part 130 may be formed to separate the oil blocking plate 110 from the rotor 22 and connect the oil blocking plate 110 to the upper end of the drive shaft 30.

The support part 130 may be formed to protrude downward from the lower surface of the oil blocking plate 110 and to contact the upper end of the drive shaft 30.

The length Ls of the support part 130 may be determined to prevent or minimize stagnation of the oil-containing refrigerant passing through the motor 20 between the oil blocking guide 100 and the motor 20. To this end, the length Ls of the support part 130 may be determined within a range of 0.5 to 1.2 times the diameter Dr of the rotor 22.

The support part 130 may include a through hole 131. The through hole 131 may be formed at the center of the support part 130 to penetrate the support part 130 in the longitudinal direction. The through hole 131 may be formed so that a bolt 135 coupling the oil blocking guide 100 to the drive shaft 30 is inserted into the through hole 131.

The coupling groove 39 may be formed at the upper end of the drive shaft 30. A female thread into which the bolt 135 is fastened may be formed on the inner circumferential surface of the coupling groove 39. Therefore, when the bolt 135 is inserted into the through hole 131 of the support part 130 of the oil blocking guide 100 and one end of the bolt 135 is fastened to the coupling groove 39 of the drive shaft 30, the oil blocking guide 100 may be coupled to the upper end of the drive shaft 30. When the oil blocking guide 100 is coupled to the upper end of the drive shaft 30 with the bolt 135, the oil blocking guide 100 may rotate integrally with the drive shaft 30.

The oil blocking guide 100 may be disposed below the refrigerant discharge pipe 14 so that the refrigerant moving along the oil guide part 120 flows into the refrigerant discharge pipe 14. In other words, the oil blocking guide 100 may be disposed below the refrigerant discharge pipe 14 to be spaced apart from the lower end of the refrigerant discharge pipe 14 by a predetermined distance.

To this end, the oil blocking guide 100 may be disposed such that the oil blocking plate 110 is spaced apart from the lower end of the refrigerant discharge pipe 14 by a predetermined distance. The distance G between the oil blocking plate 110 and the refrigerant discharge pipe 14 may be determined based on the diameter Dt of the refrigerant discharge pipe 14. For example, the distance G between the oil blocking plate 110 of the oil blocking guide 100 and the lower end of the refrigerant discharge pipe 14 may be determined in the range of 0.5 to 5 times the diameter Dt of the refrigerant discharge pipe 14.

When the distance G between the oil blocking plate 110 and the refrigerant discharge pipe 14 is out of the above range, the discharge of the refrigerant through the refrigerant discharge pipe 14 may be hindered.

As described above, when the oil blocking guide 100 that rotates integrally with the drive shaft 30 is disposed above the rotor 22, the oil is separated from the refrigerant passing through the rotor 22 and moves to the inner circumferential surface of the casing 10, and the refrigerant may move upward along the oil guide part 120 of the oil blocking guide 100 and flow into the refrigerant discharge pipe 14. Therefore, the hermetic compressor 1 according to one or more embodiments of the disclosure may minimize the amount of oil flowing into the refrigerant discharge pipe 14 along with the refrigerant.

Figure 7:
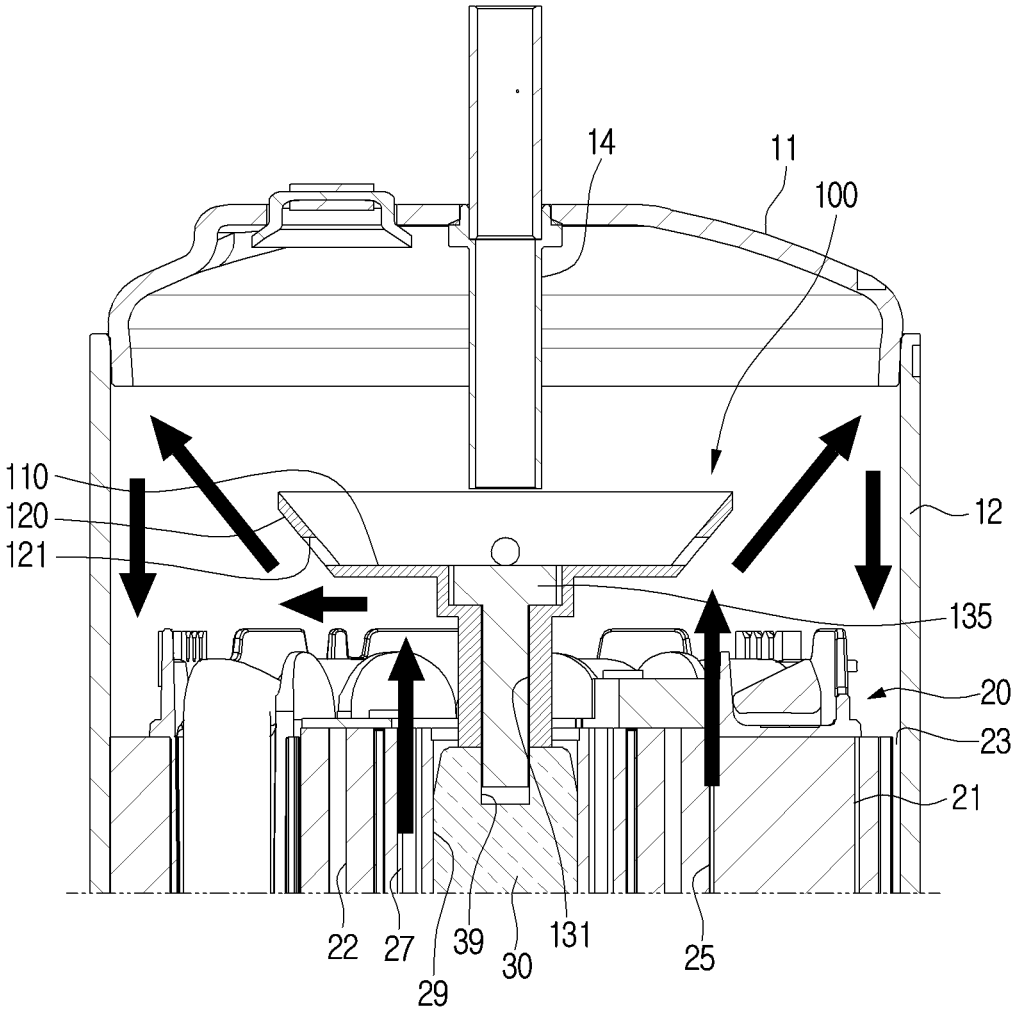
FIG. 7 is a cross-sectional view illustrating a flow of oil in a hermetic compressor according to one or more embodiments of the disclosure.

FIG. 7 is a cross-sectional view illustrating a flow of oil in a hermetic compressor according to one or more embodiments of the disclosure.

Referring to FIG. 7, the oil passes through the motor 20 together with the refrigerant and moves upward. For example, the oil and refrigerant may move to the upper side of the motor 20 through the plurality of refrigerant holes 27 provided in the rotor 22. In addition, the oil and refrigerant may move to the upper side of the motor 20 through the gap 25 between the rotor 22 and the stator 21.

The oil and refrigerant moving to the upper side of the motor 20 are blocked by the oil blocking guide 100 and move in a horizontal direction. In other words, the upward movement of the oil and the refrigerant is blocked by the oil blocking plate 110 of the oil blocking guide 100, and the oil and refrigerant move in a horizontal direction along the oil blocking plate 110.

The oil and refrigerant moving in the horizontal direction along the oil blocking plate 110 move upward in an inclined direction along the oil guide part 120 provided at the edge of the oil blocking plate 110. At this time, because the oil blocking guide 100 rotates integrally with the drive shaft 30, the oil having the high-density moves toward the upper portion of the inner circumferential surface of the casing 10 along the oil guide part 120 by the centrifugal force. The refrigerant having the low-density moves along the oil guide part 120 to the upper end of the oil guide part 120, and then flows into the refrigerant discharge pipe 14.

The oil and refrigerant that have moved upward along the gap 25 between the rotor 22 and the stator 21 may move upward in an inclined direction by the oil guide part 120 of the oil blocking guide 100. The oil having the high-density moves along the oil guide part 120, and then moves toward the upper portion of the inner circumferential surface of the casing 10 by the centrifugal force. The refrigerant having the low-density moves upward along the oil guide part 120 and flows into the refrigerant discharge pipe 14.

The oil separated from the refrigerant and moved to the inner circumferential surface of the casing 10 by the oil blocking guide 100 moves downward along the inner circumferential surface of the casing 10. Because the plurality of oil return passages 23 are provided between the inner circumferential surface of the casing 10 and the outer circumferential surface of the stator 21, the oil moves below the motor 20 through the plurality of oil return passages 23. The oil that has moved below the motor 20 is collected in the oil reservoir 16.

In the hermetic compressor 1 according to one or more embodiments of the disclosure having the above-described structure, the flow of the oil-containing refrigerant is not stagnant between the oil blocking guide 100 and the motor 20, so the flow rate of the refrigerant is not reduced by the oil blocking guide 100. Therefore, because the dynamic pressure of the refrigerant is not lost, the efficiency of the hermetic compressor 1 may be not reduced.

In addition, because the oil blocking guide 100 separates oil from the refrigerant, it is possible to prevent or minimize the oil from being discharged together with the refrigerant through the refrigerant discharge pipe 14.

The oil separated by the oil blocking guide 100 may move below the motor 20 through the plurality of oil return passages 23 between the casing 10 and the stator 21, and then may be collected in the oil reservoir 16. Therefore, it is possible to prevent deterioration in operational reliability of the hermetic compressor 1 due to wear or overheating of internal parts caused by a lack of oil inside the hermetic compressor 1.

In order to check the effect of the hermetic compressor 1 according to one or more embodiments of the disclosure having the above structure, computational fluid dynamics were performed on the hermetic compressor 1 according to one or more embodiments of the disclosure and the hermetic compressors 200 and 201 according to the related art.

Hereinafter, the refrigerant flow of the hermetic compressor 1 according to one or more embodiments of the disclosure will be described in comparison with the refrigerant flow of the hermetic compressors 200 and 201 according to the related art without the oil blocking guide 100 with reference to FIGS. 8 to 10.

Figure 8:
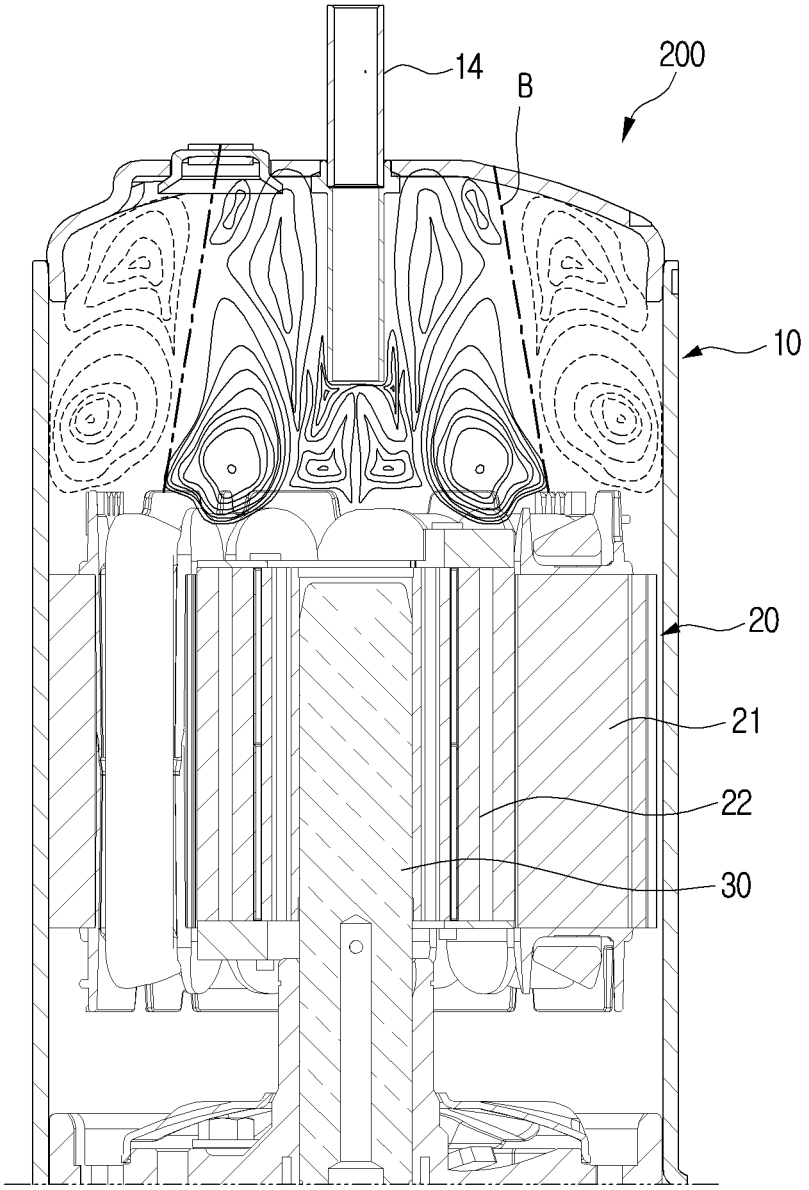
FIG. 8 is a cross-sectional view illustrating a flow of refrigerant in a hermetic compressor without an oil blocking guide.
Figure 9:
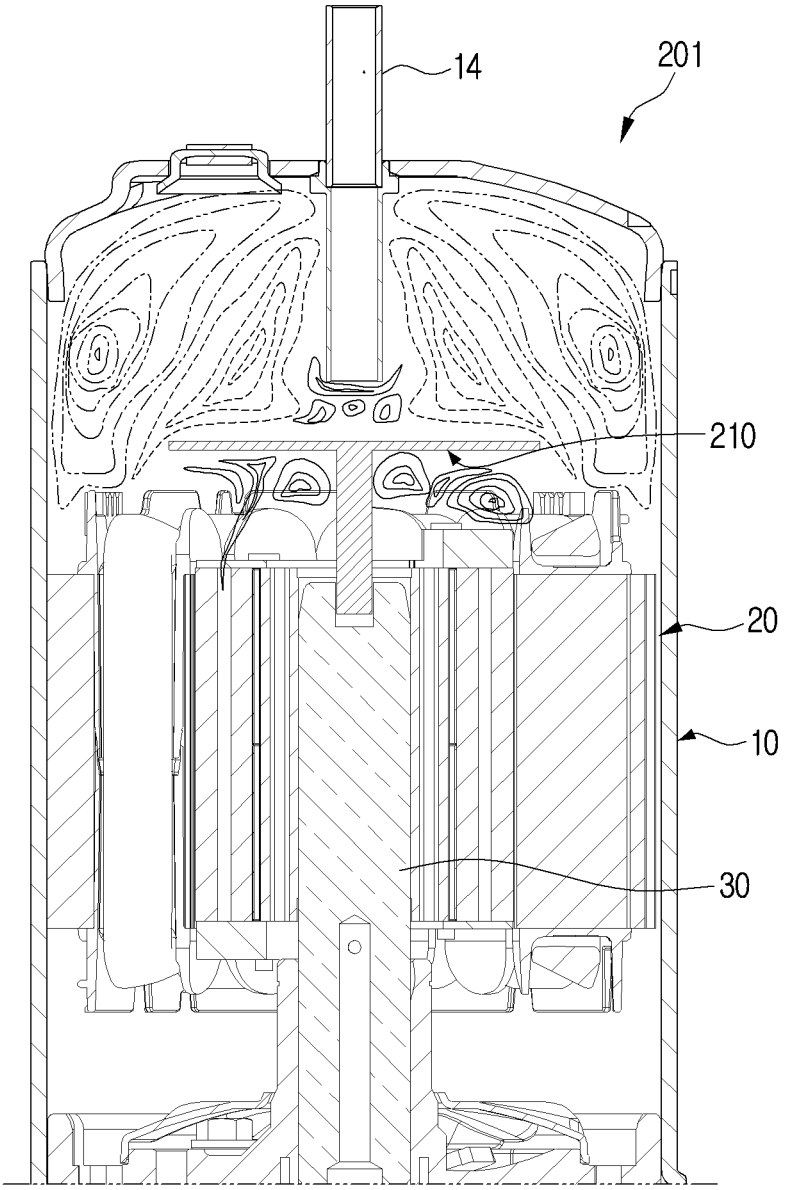
FIG. 9 is a cross-sectional view illustrating a flow of refrigerant in a hermetic compressor having only an oil blocking plate.
Figure 10:
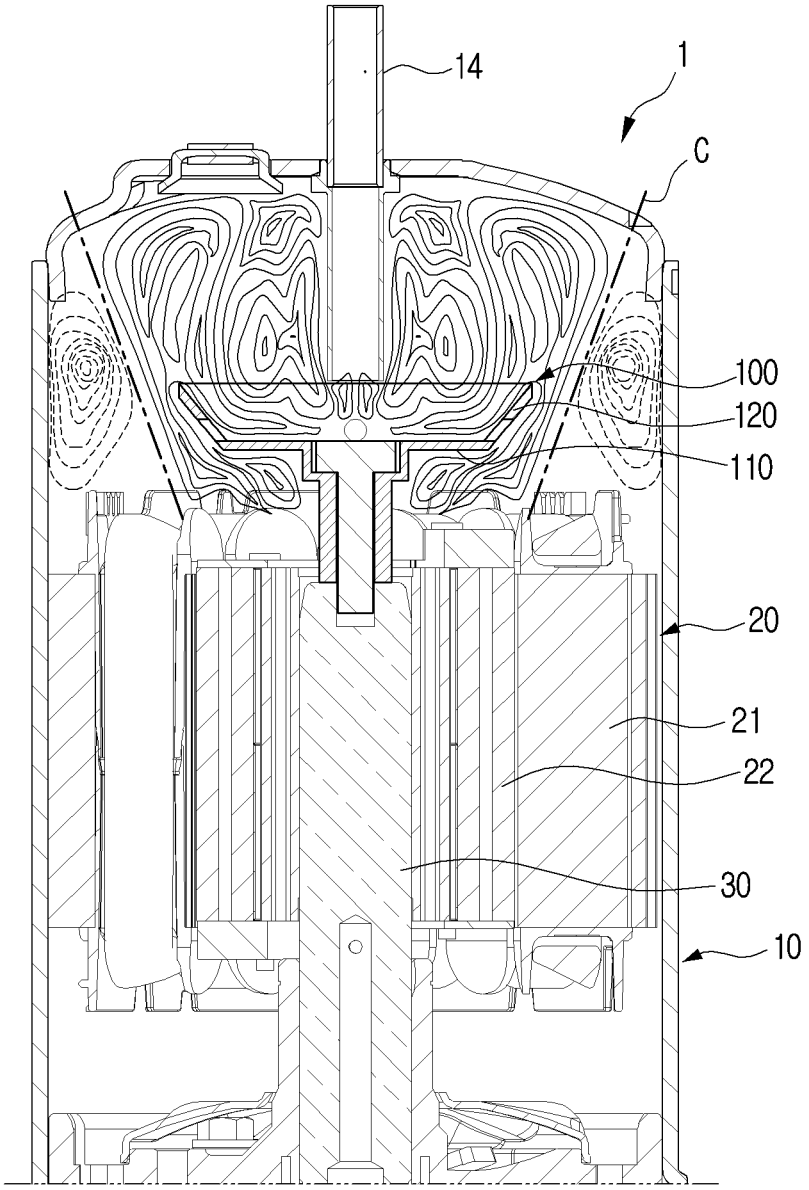
FIG. 10 is a cross-sectional view illustrating a flow of refrigerant in a hermetic compressor according to one or more embodiments of the disclosure.

For reference, the drawings of FIGS. 8 to 10 schematically show two-dimensional flow analysis performed on the flow of the oil-containing refrigerant in the hermetic compressors 1, 200, and 201. In addition, in FIGS. 8 to 10, the type of stream line indicates the flow rate of the refrigerant. In detail, a stream line indicated by a solid line indicates a flow rate faster than a stream line indicated by a dotted line, and the stream line indicated by the dotted line indicates a flow rate faster than a stream line indicated by an alternated long and two short dashes line. In other words, the flow rate of the solid line is the fastest, and the flow rate of the alternated long and two short dashes line is the slowest. The hermetic compressors 1, 200, and 201 of FIGS. 8 to 10 have the same specifications except for the oil blocking guide 100.

FIG. 8 is a cross-sectional view illustrating a flow of refrigerant in a hermetic compressor without an oil blocking guide.

Referring to FIG. 8, the hermetic compressor 200 does not include the oil blocking guide 100. In other words, the oil blocking guide 100 is not disposed at the upper end of the drive shaft 30 of the hermetic compressor 200.

As illustrated in FIG. 8, when the oil blocking guide 100 is not disposed at the upper end of the drive shaft 30, the flow of the refrigerant tends to be concentrated in the center of the inner space of the casing 10 (see dotted line B in FIG. 8). When the refrigerant is concentrated in the center of the inner space of the casing 10, because the refrigerant contains oil, a large amount of oil is discharged to the outside of the hermetic compressor 200 through the refrigerant discharge pipe 14 together with the refrigerant. In other words, in the hermetic compressor 200 without the oil blocking guide as illustrated in FIG. 8, because oil is not separated from the refrigerant, a large amount of oil is discharged through the refrigerant discharge pipe 14 together with the refrigerant.

When a large amount of oil is discharged to the refrigerating cycle through the refrigerant discharge pipe 14 as in the hermetic compressor 200 shown in FIG. 8, the hermetic compressor 200 runs out of oil. When the oil inside the hermetic compressor 200 is insufficient, the reliability of operation of the hermetic compressor 200 may deteriorate as internal parts of the hermetic compressor 200 are worn out and overheated. In addition, when a large amount of oil flows along the refrigerating cycle, the reliability of the entire refrigerating cycle may be deteriorated.

FIG. 9 is a cross-sectional view illustrating a flow of refrigerant in a hermetic compressor having only an oil blocking plate.

Referring to FIG. 9, the hermetic compressor 201 includes an oil blocking plate 210 and does not include an oil guide part. In other words, only the oil blocking plate 210 is disposed at the upper end of the drive shaft 30 of the hermetic compressor 201.

When the oil blocking plate 210 is disposed at the upper end of the drive shaft 30 as illustrated in FIG. 9, it is possible to prevent or reduce the phenomenon in which the refrigerant containing oil is concentrated toward the center and directly discharged through the refrigerant discharge pipe 14.

However, as illustrated in FIG. 9, the refrigerant containing oil is stagnant in the space between the oil blocking plate 210 and the upper surface of the motor 20. In other words, a vortex of the refrigerant containing oil is generated between the oil blocking plate 210 and the motor 20. When the refrigerant containing oil stagnates between the oil blocking plate 210 and the motor 20, the flow rate of the refrigerant moving to the refrigerant discharge pipe 14 is reduced. When the flow rate of the refrigerant decreases inside the casing 10, a dynamic pressure loss may occur. When the dynamic pressure loss occurs, the compression efficiency of the hermetic compressor 201 may decrease.

In other words, as illustrated in FIG. 9, the compression efficiency of the hermetic compressor 201 including only the oil blocking plate 210 on the upper end of the drive shaft 30 may decrease due to the dynamic pressure loss of the refrigerant.

FIG. 10 is a cross-sectional view illustrating a flow of refrigerant in a hermetic compressor according to one or more embodiments of the disclosure.

Referring to FIG. 10, the hermetic compressor 1 includes the oil blocking guide 100 including the oil blocking plate 110 and the oil guide part 120. In other words, the oil blocking plate 110 and the oil guide part 120 are disposed at the upper end of the drive shaft 30 of the hermetic compressor 1.

Referring to FIG. 10, it can be seen that the oil containing refrigerant moving upward through the motor 20 is blocked by the oil blocking plate 110 and does not directly move to the refrigerant discharge pipe 14. In addition, it can be seen that the oil-containing refrigerant moves upward along the oil guide part 120 without being stagnant in the space between the oil blocking plate 110 and the upper surface of the rotor 22. At this time, the flow rate of the refrigerant may not greatly decrease. In addition, the flow of the oil-containing refrigerant may be formed in a form of divergence along the oil guide part 120 of the oil blocking guide 100 (see dotted line C in FIG. 10). When the flow of the oil-containing refrigerant diverges, the oil may be separated from the refrigerant.

In other words, in the hermetic compressor 1 according to one or more embodiments of the disclosure having the structure as illustrated in FIG. 10, the phenomenon in which the flow of the refrigerant is stagnant and the flow rate of the refrigerant is reduced may be suppressed, and the refrigerant may be guided upward along the oil blocking guide 100. In other words, the oil blocking guide 100 used in the hermetic compressor 1 according to one or more embodiments of the disclosure may guide the flow of refrigerant and oil, so that the oil is separated from the refrigerant and moves to the inner circumferential surface of the casing 10 and the refrigerant is discharged to the outside of the casing 10 through the refrigerant discharge pipe 14.

In addition, when the oil blocking guide 100 is provided like the hermetic compressor 1 according to one or more embodiments of the disclosure, compared to the hermetic compressor 201 in which only the oil blocking plate 210 is disposed at the upper end of the drive shaft 30 as illustrated in FIG. 9, the average total pressure applied to the oil blocking plate 110 may increase. When the average total pressure inside the casing 10 is low, the compression efficiency of the hermetic compressor 1 may decrease.

As a result of the flow analysis, the average total pressure applied to the oil blocking plate 210 of the hermetic compressor 201 according to the related art of FIG. 9 is 9.8 kPa, and the average total pressure applied to the oil blocking guide 100 of the hermetic compressor 1 according to one or more embodiments of the disclosure of FIG. 10 is 13.4 kPa. Therefore, the compression efficiency of the hermetic compressor 1 according to one or more embodiments of the disclosure may be improved compared to the hermetic compressor 201 having only the oil blocking plate 210.

In addition, in order to check the oil separation effect of the hermetic compressor 1 according to one or more embodiments of the disclosure, the oil circulation ratio OCR of the hermetic compressor 1 according to the disclosure and the oil circulation ratio of the hermetic compressor without the oil blocking guide 100 were compared.

The oil circulation ratio may refer to a ratio of oil included in the refrigerant discharged through the refrigerant discharge pipe 14. For example, when the amount of refrigerant discharged through the refrigerant discharge pipe 14 for a predetermined period of time is 1000 g and 10 g of this amount is oil, the oil circulation ratio is 1%.

The hermetic compressor 200 according to the related art compared to the disclosure has the same specifications as the hermetic compressor 1 according to one or more embodiments of the disclosure, except that the oil blocking guide 100 is not provided.

Figure 11:
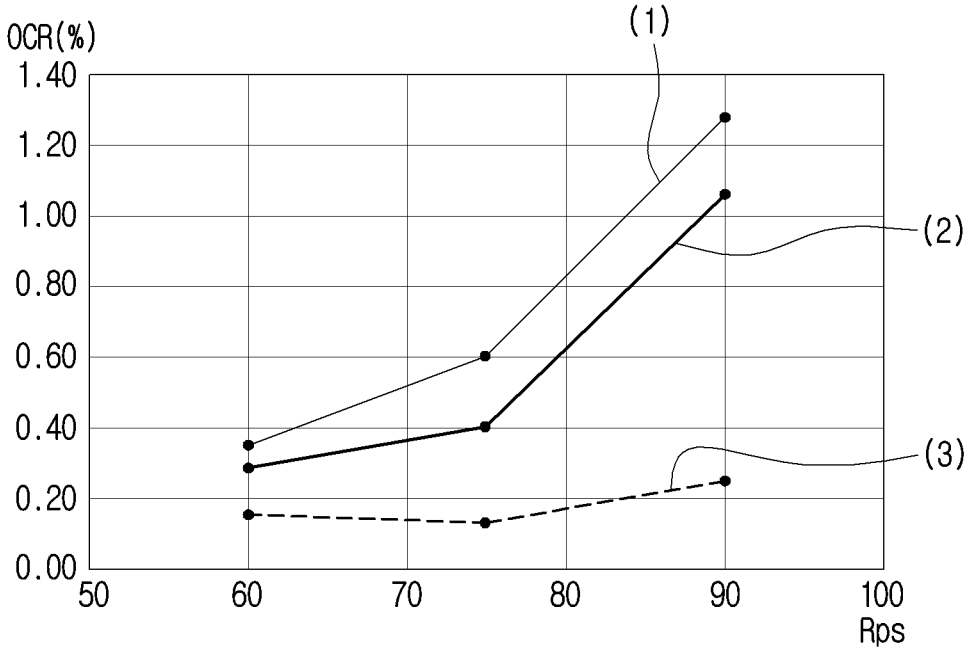
FIG. 11 is a graph comparing oil circulation ratio of a hermetic compressor having an oil blocking guide according to one or more embodiments of the disclosure and oil circulation ratio of a hermetic compressor without an oil blocking guide.

FIG. 11 is a graph comparing the oil circulation ratio of a hermetic compressor having an oil blocking guide according to one or more embodiments of the disclosure and the oil circulation ratio of a hermetic compressor without an oil blocking guide.

In FIG. 11, the horizontal axis represents the rotation speed of the rotor, and the unit thereof is the number of rotations per second (rounds/sec). The vertical axis represents the oil circulation ratio, and the unit thereof is %. Line (1) represents the oil circulation ratio of the hermetic compressor 200 according to the related art. Lines (2) and (3) represent oil circulation ratios of the hermetic compressor 1 according to one or more embodiments of the disclosure. Lines (2) and (3) have different distances G between the lower end of the refrigerant discharge pipe 14 and the oil blocking plate 110 (see FIG. 3). In line (2), the distance G between the refrigerant discharge pipe 14 and the oil blocking plate 110 is 25 mm, and in line (3), the distance G between the refrigerant discharge pipe 14 and the oil blocking plate 110 is 13 mm.

Referring to line (1) in FIG. 11, in the case of the hermetic compressor according to the related art, when the rotation speed is 60 rps, the oil circulation ratio is about 0.36%. When the rotation speed is 75 rps, the oil circulation ratio is about 0.6%. When the rotation speed is 90 rps, the oil circulation ratio is about 1.28%.

In other words, it can be seen that in the hermetic compressor according to the related art without the oil blocking guide 100, when the rotation speed increases, the oil circulation ratio increases rapidly.

Referring to line (2) in FIG. 11, in the hermetic compressor 1 according to one or more embodiments of the disclosure in which the distance G between the oil blocking plate 110 and the refrigerant discharge pipe 14 is 25 mm, when the rotation speed is 60 rps, the oil circulation ratio is about 0.3%. When the rotation speed is 75 rps, the oil circulation ratio is about 0.4%. When the rotation speed is 90 rps, the oil circulation ratio is about 1.08%.

In other words, the hermetic compressor 1 according to one or more embodiments of the disclosure in which the distance G between the oil blocking plate 110 and the refrigerant discharge pipe 14 is 25 mm has a lower oil circulation ratio than the hermetic compressor according to the related art. However, in the hermetic compressor 1 according to one or more embodiments of the disclosure in which the distance G between the oil blocking plate 110 and the refrigerant discharge pipe 14 is 25 mm, similar to the hermetic compressor according to the related art, when the rotation speed increases, the oil circulation ratio increases rapidly.

Referring to line (3) in FIG. 11, in the hermetic compressor 1 according to one or more embodiments of the disclosure in which the distance G between the oil blocking plate 110 and the refrigerant discharge pipe 14 is 13 mm, when the rotation speed is 60 rps, the oil circulation ratio is about 0.15%. When the rotation speed is 75 rps, the oil circulation ratio is about 0.13%. When the rotation speed is 90 rps, the oil circulation ratio is about 0.25%.

In other words, the hermetic compressor 1 according to one or more embodiments of the disclosure in which the distance G between the oil blocking plate 110 and the refrigerant discharge pipe 14 is 13 mm has a lower oil circulation ratio than the hermetic compressor according to the related art. In addition, the hermetic compressor 1 according to one or more embodiments of the disclosure in which the distance G between the oil blocking plate 110 and the refrigerant discharge pipe 14 is 13 mm has a lower oil circulation ratio than the hermetic compressor 1 according to one or more embodiments of the disclosure in which the distance G between the oil blocking plate 110 and the refrigerant discharge pipe 14 is 25 mm.

That is, it can be seen that the oil circulation ratio is lowered when the distance G between the oil blocking plate 110 and the refrigerant discharge pipe 14 is reduced. In other words, when the distance G between the oil blocking plate 110 and the refrigerant discharge pipe 14 is reduced, the oil separation efficiency by the oil blocking guide 100 may be increased.

Therefore, when the rotation speed of the hermetic compressor 1 increases, the amount of oil discharged through the refrigerant discharge pipe 14 is significantly reduced. In other words, in the hermetic compressor 1 according to one or more embodiments of the disclosure in which the distance G between the oil blocking plate 110 and the refrigerant discharge pipe 14 is 13 mm, the oil circulation ratio does not significantly increase when the rotation speed increases.

Therefore, when the rotation speed is 90 rps, the hermetic compressor 1 according to one or more embodiments of the disclosure in which the distance G between the oil blocking plate 110 and the refrigerant discharge pipe 14 is 13 mm may improve the oil circulation ratio by up to about 80.5% compared to the hermetic compressor according to the related art.

In the above, the case where the oil blocking guide 100 includes the support part 130 has been described, but the oil blocking guide 100 may not include the support part 130. In this case, the upper end of the drive shaft 30 may protrude upward than the motor 20. Hereinafter, a hermetic compressor in which the oil blocking guide 100 does not include the support part 130 will be described with reference to FIG. 12.

Figure 12:
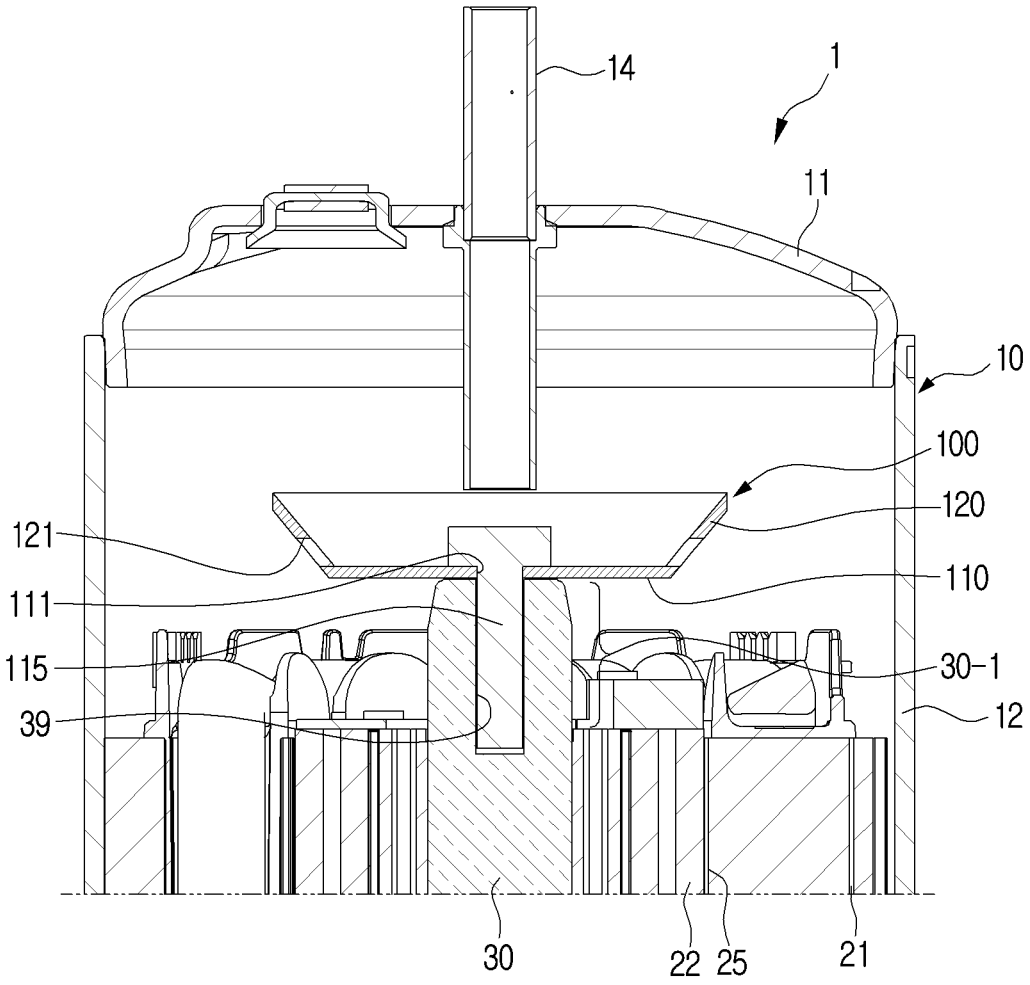
FIG. 12 is a partial cross-sectional view illustrating a hermetic compressor according to one or more embodiments of the disclosure.

FIG. 12 is a partial cross-sectional view illustrating a hermetic compressor according to one or more embodiments of the disclosure.

The hermetic compressor 1 according to one or more embodiments of the disclosure is the same as the hermetic compressor 1 according to the above-described embodiment except for the oil blocking guide 100 and the drive shaft 30. Therefore, only the oil blocking guide 100 and the drive shaft 30 will be described below.

Referring to FIG. 12, the oil blocking guide 100 may include an oil blocking plate 110 and an oil guide part 120.

The oil blocking plate 110 may be formed to prevent the oil-containing refrigerant that has passed through the motor 20 from moving upward. In other words, the oil blocking plate 110 may be formed to block the upward movement of the oil included in the refrigerant. Because the upward movement of the oil is blocked by the oil blocking plate 110, the oil may not directly flow into the refrigerant discharge pipe 14.

The oil blocking plate 110 may be formed in a disk shape. The oil blocking plate 110 may be disposed to be spaced apart from the motor 20 upward by a predetermined distance. In other words, the oil blocking plate 110 may be disposed at a predetermined distance from the upper surface of the rotor 22.

A through hole 111 may be formed in the center of the oil blocking plate 110. The oil blocking plate 110 may be fixed to the upper end of the drive shaft 30 by inserting a bolt into the through hole 111.

The oil guide part 120 may be formed to guide oil contained in the refrigerant to the inner circumferential surface of the casing 10. The oil guide part 120 may extend obliquely upward with respect to the oil blocking plate 110 from the outer circumferential surface of the oil blocking plate 110. Then, when the oil blocking guide 100 rotates, the oil guide part 120 may guide the oil to the inner circumferential surface of the casing 10.

The oil guide part 120 may be inclined at an angle of 30 degrees to 70 degrees with respect to a straight line perpendicular to the oil blocking plate 110. In other words, the oil guide part 120 may be formed to be inclined at an angle of 20 degrees to 60 degrees upward with respect to the lower surface of the oil blocking plate 110 from the edge of the oil blocking plate 110.

Therefore, the oil guide part 120 may be formed in a form that diverges upward from the oil blocking plate 110. That is, the oil guide part 120 may be formed in a hollow truncated cone shape. In other words, the oil guide part 120 may have an inverted truncated cone shape in which the diameter of the upper surface is greater than the diameter of the lower surface. That is, the oil guide part 120 may be formed in a trumpet shape where the diameter of the lower surface is smaller than the diameter of the upper surface.

Therefore, the oil blocking plate 110 and the oil guide part 120 may form a bowl with a flat bottom and an inclined side surface.

The refrigerant and oil whose upward movement is blocked by the oil blocking plate 110 move upward along the oil guide part 120. At this time, when the oil blocking guide 100 rotates, a centrifugal force acts on the refrigerant and oil flowing along the oil guide part 120.

In general, because the density of oil is greater than that of the refrigerant, when a centrifugal force acts on the outer circumferential surface of the oil guide part 120 as the oil blocking guide 100 rotates, oil is separated from the refrigerant, and then moves toward the inner circumferential surface of the casing 10. Because the centrifugal force acting on the refrigerant is small, the refrigerant moves along the oil guide part 120 to the upper side of the oil blocking guide 100, and then flows into the refrigerant discharge pipe 14. Thus, the oil guide part 120 may separate the oil from the refrigerant.

The oil guide part 120 may be disposed so that the refrigerant moving along the oil guide part 120 flows into the refrigerant discharge pipe 14. In other words, the oil guide part 120 may be disposed so as not to prevent the refrigerant from flowing into the refrigerant discharge pipe 14.

For example, the oil guide part 120 may be formed so as not to contact the upper surface of the casing 10, that is, the upper surface of the upper casing 11 where the refrigerant discharge pipe 14 is provided. The oil guide part 120 may be formed so that its upper end is located below the lower end of the refrigerant discharge pipe 14. As another example, the oil guide part 120 may be formed so that the upper end of the oil guide part 120 is positioned slightly higher than the lower end of the refrigerant discharge pipe 14.

The oil guide part 120 may include a plurality of oil outlets 121. The plurality of oil outlets 121 are formed to pass through the oil guide part 120. Accordingly, the inner space of the oil guide part 120 may communicate with the outside through the plurality of oil outlets 121. The plurality of oil outlets 121 may be formed in contact with or adjacent to the oil blocking plate 110.

Oil existing on the oil guide part 120 may be discharged to the outside of the oil guide part 120 through the plurality of oil outlets 121. When the oil blocking guide 100 rotates, the oil inside the oil guide part 120 may be discharged to the outside of the oil guide part 120 through the plurality of oil outlets 121, and moved inside the casing 10 by the centrifugal force.

The oil blocking guide 100 may be formed to have a diameter equal to or larger than that of the rotor 22 of the motor 20. Here, the diameter of the oil blocking guide 100 refers to the maximum diameter of the oil blocking guide 100. In detail, the diameter of the oil blocking guide 100 refers to the outer diameter of the upper end of the oil guide part 120.

The oil guide part 120 may be formed to be positioned above the gap 25 between the rotor 22 and the stator 21. When the oil guide part 120 is formed in this way, the oil-containing refrigerant moving to the upper side of the motor 20 through the gap 25 between the rotor 22 and the stator 21 may be directly guided by the oil guide part 120 and move upward in an inclined direction without colliding with the oil blocking plate 110.

The oil blocking plate 110 may be formed to have a smaller diameter than the diameter of the oil blocking guide 100, that is, the diameter of the oil guide part 120. The diameter of the oil blocking plate 110 may be the diameter of the lower end of the oil guide part 120.

The oil blocking plate 110 and the oil guide part 120 of the oil blocking guide 100 may have the same dimensions as those of the oil blocking guide 100 according to the above-described embodiment.

In the case of this embodiment, in order to secure a gap between the oil blocking guide 100 and the motor 20, as illustrated in FIG. 12, the drive shaft 30 may protrude upward from the motor 20. In other words, a protruding portion 30-1 of the drive shaft 30 may serve as the support part 130 of the oil blocking guide 100 according to the above-described embodiment.

A coupling groove 39 may be formed at the upper end of the drive shaft 30 protruding upward from the motor 20. A female thread is formed in the coupling groove 39. Therefore, the oil blocking guide 100 may be fixed to the upper end of the drive shaft 30 using a bolt 115.

Because the oil blocking guide 100 shown in FIG. 12 has the same function as the oil blocking guide 100 according to the above-described embodiment, the flow rate of the refrigerant is not reduced by the oil blocking guide 100. Therefore, because the dynamic pressure of the refrigerant is not lost, the efficiency of the hermetic compressor 1 may not be reduced.

In addition, because the oil blocking guide 100 separates the oil from the refrigerant, it is possible to prevent or minimize the oil from being discharged together with the refrigerant through the refrigerant discharge pipe 14. Therefore, it is possible to prevent deterioration in the operational reliability of the hermetic compressor 1 due to wear or overheating of internal parts caused by a lack of oil inside the hermetic compressor 1.

In the foregoing, the disclosure has been shown and described with reference to various embodiments. However, it is understood by those skilled in the art that various changes may be made in form and detail without departing from the scope of the disclosure as defined by the appended claims and equivalents thereof.

What is claimed is:

1. A hermetic compressor comprising:

a casing;

a motor inside the casing, and including a rotor, a stator, and a gap between the rotor and the stator;

a drive shaft configured to rotate with the rotor;

a compression unit below the motor and configured to compress refrigerant and discharge compressed refrigerant to an inside of the casing according to rotation of the drive shaft; and an oil blocking guide above the motor and configured to rotate integrally with the rotor, wherein the oil blocking guide includes:

an oil blocking plate formed in a disk shape, an oil guide part extending upward and angling outward from an edge of the oil blocking plate to a diameter of the oil blocking guide, the oil guide part disposed above the gap of the motor, and a support part connecting the oil blocking plate to the drive shaft so as to space the oil blocking plate from the rotor, wherein the oil blocking plate and the oil guide part block upward movement of oil passing through the motor, and guide the oil passing through the motor to an inner circumferential surface of the casing through centrifugal force while the oil blocking guide is rotating.

2. The hermetic compressor of claim 1, wherein the diameter of the oil blocking guide is equal to or larger than a diameter of the rotor of the motor.

3. The hermetic compressor of claim 2, wherein a ratio of the diameter of the oil blocking guide to the diameter of the rotor is in a range of 1.0 to 1.7.

4. The hermetic compressor of claim 3, wherein a diameter of the oil blocking plate is smaller than the diameter of the oil blocking guide.

5. The hermetic compressor of claim 4, wherein a ratio of the diameter of the oil blocking plate to the diameter of the rotor is in a range of 0.7 to 1.2.

6. The hermetic compressor of claim 1, wherein the oil guide part is inclined in a range of 30 degrees to 70 degrees with respect to a rotational axis of the oil guide part.

7. The hermetic compressor of claim 6, wherein the oil guide part is formed in a hollow truncated cone shape.

8. The hermetic compressor of claim 7, wherein the oil guide part includes a plurality of oil outlets passing through the oil guide part.

9. The hermetic compressor of claim 1, wherein the support part includes a through hole, the drive shaft includes a coupling groove formed at an upper end of the drive shaft, and the oil blocking guide is coupled to the drive shaft by a bolt inserted into the through hole of the support part and coupled to the coupling groove.

10. The hermetic compressor of claim 1, wherein a length of the support part is less than a diameter of the rotor.

11. The hermetic compressor of claim 1, further comprising:

a refrigerant discharge pipe provided on an upper surface of the casing, wherein the oil blocking guide is disposed at a predetermined distance below the refrigerant discharge pipe.

12. The hermetic compressor of claim 11, wherein a distance between the oil blocking plate of the oil blocking guide and a lower end of the refrigerant discharge pipe is in a range of 0.5 to 5 times a diameter of the refrigerant discharge pipe.

13. A hermetic compressor comprising:

a casing;

a motor inside the casing, and including a rotor, a stator, and a gap between the rotor and the stator;

a drive shaft configured to rotate with the rotor;

a compression unit below the motor and configured to compress refrigerant and discharge compressed refrigerant to an inside of the casing according to rotation of the drive shaft; and an oil blocking guide above the motor and configured to rotate integrally with the rotor, wherein the oil blocking guide includes:

an oil blocking plate formed in a disk shape and spaced a predetermined distance from an upper end of the rotor, and an oil guide part extending upward and angling outward from an edge of the oil blocking plate to a diameter of the oil blocking guide, the oil guide part disposed above the gap of the motor, wherein the oil blocking plate and the oil guide part block upward movement of oil passing through the motor, and guide the oil passing through the motor to an inner circumferential surface of the casing through centrifugal force while the oil blocking guide is rotating.

14. The hermetic compressor of claim 13, wherein the diameter of the oil blocking guide is equal to or larger than a diameter of the rotor of the motor.

15. The hermetic compressor of claim 13, wherein a diameter of the oil blocking plate is smaller than a diameter of the oil blocking guide.

* * * * *